US006945181B2

(12) United States Patent
Tanner

(10) Patent No.: US 6,945,181 B2
(45) Date of Patent: Sep. 20, 2005

(54) METHOD FOR COMBUSTING AN ORGANIC WASTE CONCENTRATE CONTAINING ALKALI METAL COMPOUNDS UNDER OXIDATIVE CONDITIONS

(75) Inventor: Teemu Tanner, Helsinki (FI)

(73) Assignee: Rinheat Oy, Espoo (FI)

( * ) Notice: Subject to any disclaimer, the term of this patent is extended or adjusted under 35 U.S.C. 154(b) by 0 days.

(21) Appl. No.: 10/780,632

(22) Filed: Feb. 19, 2004

(65) Prior Publication Data

US 2005/0150440 A1 Jul. 14, 2005

(30) Foreign Application Priority Data

Jan. 14, 2004 (FI) ..... 20040040

(51) Int. Cl.[7] ..... F23L 7/00
(52) U.S. Cl. ..... 110/348
(58) Field of Search ..... 110/238, 348; 162/30.1, 30.11, 239, 240

(56) References Cited

U.S. PATENT DOCUMENTS 4,773,918 A * 9/1988 Kohl ..... 48/197 R
5,653,861 A * 8/1997 Landfors et al. ..... 205/746
5,814,189 A * 9/1998 Stigsson et al. ..... 162/30.11
6,062,547 A * 5/2000 Nilsson ..... 261/108

FOREIGN PATENT DOCUMENTS

WO WO 03/062526 7/2003

OTHER PUBLICATIONS

Brian K. Batchelor, "*Sonoco Chemical Recover Plant-Operational Experiences*", Appita vol. 33, No. 6, pp. 447 to 453 (May 1980).

* cited by examiner

*Primary Examiner*—Kenneth Rinehart
(74) *Attorney, Agent, or Firm*—Burns, Doane, Swecker & Mathis, LLP

(57) ABSTRACT

The invention relates to a method for combusting an organic waste concentrate, which contains alkali metal compounds, under oxidative conditions for recovering the alkali metal compounds as alkali metal carbonates.

According to the invention, the combustion is carried out at a temperature of at least about 850° C. The formed flue gases are cooled below a sticking temperature range of the alkali carbonates by mixing, and simultaneously water (8) is poured on the walls (9) of a cooling zone (2) at least at the sticking temperature range.

20 Claims, 1 Drawing Sheet

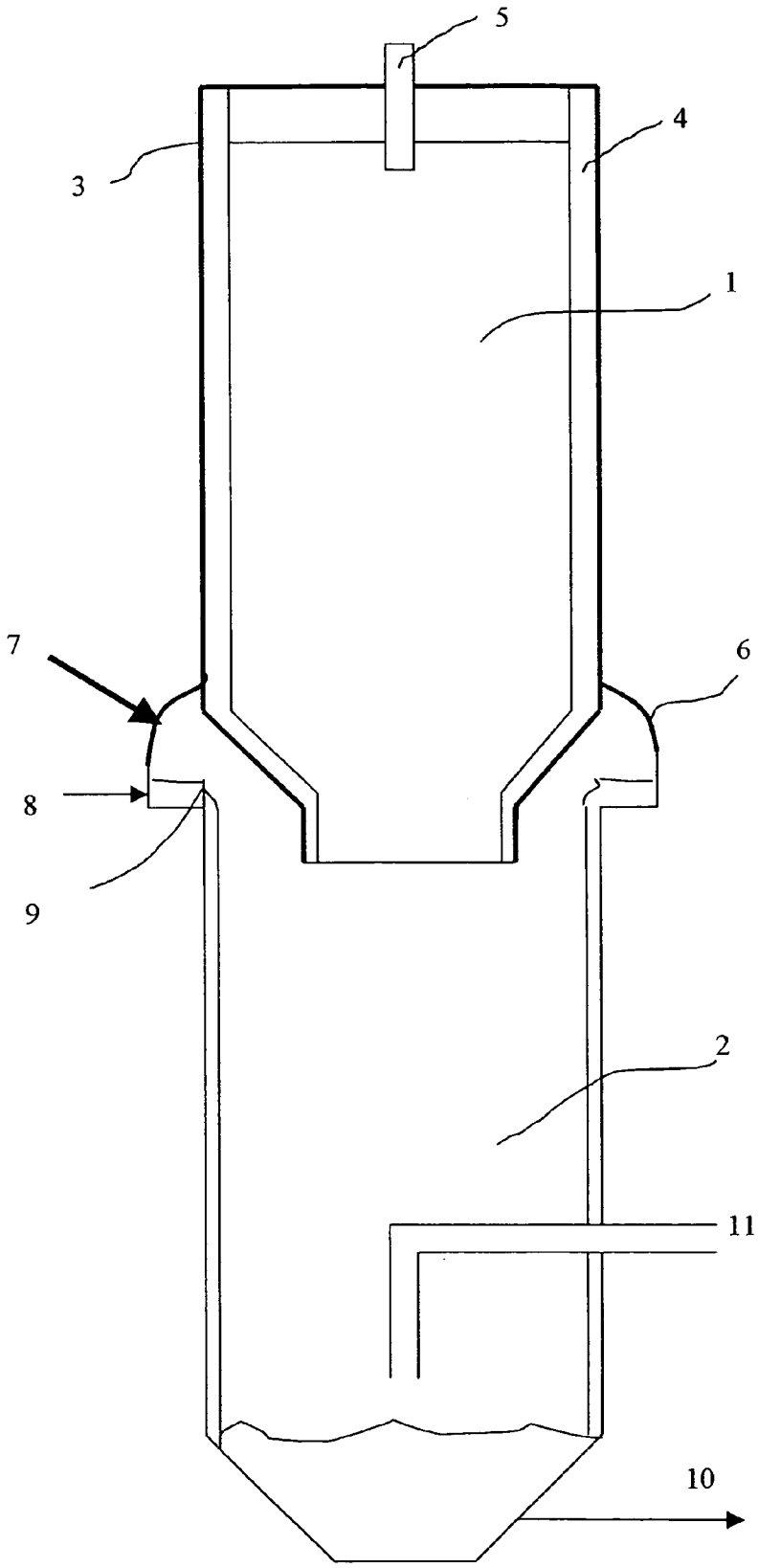
5
4
3
1
7
6
8
9
2
11
10

METHOD FOR COMBUSTING AN ORGANIC WASTE CONCENTRATE CONTAINING ALKALI METAL COMPOUNDS UNDER OXIDATIVE CONDITIONS

This invention relates to a method for combusting an organic waste concentrate, which contains alkali metal compounds, under oxidative conditions for recovering the alkali metal compounds as alkali metal carbonates.

Wood can be processed chemically or mechanically to produce fibers suitable for paper-making. In chemical processes, lignin binding the fibers of wood together is dissolved in a chemical process at an elevated temperature and pressure. The chemical solution may be either acid or basic. In an alkaline cooking process known as sulfate or kraft cooking NaOH and $Na_2S$ are used as cooking chemicals. Pulp yield prior to bleaching is about 50%. Soluble wood substance and cooking chemicals are recovered from the fiber in a washing step as a solution having a total solids content above 10%, the remainder being water. This spent liquor is concentrated by evaporation, whereupon it is combusted in a chemical recovery boiler under reductive conditions. The heat content of organic material dissolved from wood is recovered as high-pressure steam, from which electricity and process steam of a lower pressure is produced, generally by means of a turbogenerator. The chemicals form a melt at the bottom of the recovery boiler, which melt is dissolved in water. The solution having $Na_2CO_3$ and $Na_2S$ as main components, is converted by a conventional causticizing process into cooking chemicals suitable for reuse.

A cost-effective production of sulfate pulp requires the above-described combustion of spent liquor and recovery of chemicals by causticizing, requireing, however, equipments involving very high investment costs.

In mechanical defibering processes the yield of a bleached product is 90 to 97% calculated on wood. Thermo mechanical pulping process, i.e. the TMP process, is generally integrated with a paper mill. The chemical oxygen demand, i.e. COD, of the wastewater is 50 to 80 kg/ton pulp produced. This wastewater is sent to a biological purifying process in conjunction with other wastewaters of the paper mill.

Chemi-mechanical refining or CTMP plants are not equally often integrated with a paper mill, but rather, the produced pulp is bleached, dried and transported for use elsewhere. The chemical oxygen demand of wastewater from this process may be twice compared to conventional mechanically defibered pulp, whereby also the costs of waste water treatment in a biological treatment plant is roughly doubled. Furthermore, spent chemicals cannot be recovered, but instead, they are often dumped in nearby waterways thus forming an environmental hazard. In addition, it is known that the operation of a biological treatment plant is problematic due to extractives dissolved from wood into the wastewater. An original function of the extractives is to protect wood against decay.

The CTMP-process produces fibers at a high yield of above 90%, which fibers in some applications can replace sulfate pulp. In addition to the high fiber yield, the investment costs in relation to production capacity are substantially lower than in a sulfate pulping process.

In a CTMP plant, chips are traditionally impregnated with a $Na_2SO_3$ solution. Generally, chemical consumption is about 20 kg/ton pulp. After refining, the pulp is bleached by using about 20 kg $H_2O_2$/ton pulp together with an equal amount of NaOH. Further, up to 20 kg sodium silicate per ton pulp is generally used as an inhibitor.

Nowadays, also silicate free inhibitors are commercially available.

If a suitable and cost-effective chemical recovery process of the type used in sulfate pulp plants would be available to plants producing bleached chemi-mechanical refiner pulp, the overall competitive edge of a CTMP plant could be improved and the environmental load caused by the plant could be reduced.

The first steps in this direction at a full-scale plant level have already been taken in a Canadian plant producing bleached chemi-mechanical refiner pulp from aspen. The product is dried and sold.

In this plant, impregnation is carried out with a sodium sulfite solution and bleaching is carried out with alkaline peroxide. The spent liquors from both steps are concentrated by evaporation and the concentrated liquor is combusted in a recovery boiler, wherein the dissolved organic matter is burned to carbon dioxide, while the spent sodium and sulfur chemicals are reduced to a melt of $Na_2S$ and $Na_2CO_3$. In this known process, the melt is cooled and stored for possible later use. Since both compounds are water-soluble, they must be stored in dry conditions.

Industrial use of a pulping process known as the Sonoco process is described in publication Appita, Vol. 33, no. 6, pp. 447–453. The fiber to be produced herein is a so-called NSSC pulp produced by impregnating a $Na_2SO_3$ solution at elevated pressure and temperature into the chips in a continuous digester. After cooking, defibering is carried out in a refiner. Pulp yield is about 80% of the wood. The active chemicals used in the process are the same as in a CTMP process. According to the publication, chemical recovery is implemented by adding aluminum hydroxide to the evaporation process prior to final concentration. Additionally, recyclable sodium aluminate is added to the strong spent liquor and this mixture is pelletized. The pellets are combusted in a rotary kiln having a discharge-end temperature of above 900° C. Reducing conditions prevail in the interior of the pellets and the sulfur of the spent liquor is reduced to sulfide, and simultaneously sodium and aluminum form a stable sodium aluminate having a high melting temperature (1600° C.). Sulfur is released from the pellet as $H_2S$ and is immediately oxidized to $SO_2$. A part of the combusted pellets is crushed and recirculated to the pelletization of spent liquor concetrate. The remaining part of the aluminate pellets is dissolved. Sodium aluminate is water-soluble and forms a strong alkaline solution. The $SO_2$ of the flue gases is absorbed into this liquor, whereby $Na_2SO_3$ is formed and the aluminum hydroxide precipitates.

The $Na_2SO_3$ is reused for impregnation and the aluminum hydroxide is added to the evaporation of spent liquor.

Generally, the literature of the art teaches that production of a CTMP pulp requires sulfonation of lignin in the impregnation phase, that is, use of sulfite, and the pulp is normally bleached using peroxide, which process needs alkaline conditions. Conventionally, NaOH is used for adjusting the pH. The combustion of the organic matter dissolved from wood and the recovery of sodium and sulfur is possible by the known technology, such as the above-mentioned Sonoco process, but it is very demanding and requires expensive equipment investments. Alternatively, a Tampella Recovery process could be used.

In an operating mill, bleached chemi-mechanical refiner pulp is produced by using oxidized green liquor as alkali. It contains sodium carbonate ($Na_2CO_3$) as active alkali. Another main component is $Na_2SO_4$, which is inert with respect to the process. In this mill, spent liquor is evaporated to a solids content of 35 to 45% and combusted together with black liquor from a sulfate pulp mill located in the same area in a recovery boiler of said mill. In this procedure, the sodium from the production of the chemi-mechanical refiner pulp is recovered and recirculated to the impregnation and the bleaching as oxidized green liquor. The above-described procedure is preferable, but can only be implemented, if the recovery boiler of a neighboring mill has sufficiently capacity to combust also the concentrate from the production of mechanical pulp.

If the above-mentioned spent liquor concentrate cannot be combusted in a soda recovery boiler, the recirculation of chemicals must be carried out in a separate recovery system, e.g. by using circulation of Na-aluminate. A process of this kind has been described in FI patent application 20020123 and in the corresponding international publication WO 03/062526.

In this known process, fibers are washed after refining and bleaching. The dissolved organic matter and the used Na-chemicals are passed into wastewater. The solids content of the spent liquor of the bleached chemi-mechanical refiner pulp is about 1.5%, and the solids content of the spent liquor of the bleached thermo-mechanical pulp is about 0.5%.

These spent liquors can indeed be treated biologically, but, due to a high COD content, such a plant and its use will become very expensive, and additionally, all sodium used in the production of the pulp is dumped in nearby waterways.

It is an object of the present invention to provide a method for combusting an organic waste concentrate, which contains alkali metal compounds, under oxidative conditions so that the alkali metal compounds are recovered as water-soluble alkali metal carbonates.

The problem related to the combustion of an organic waste concentrate, which contains alkali metal compounds, under oxidative conditions is that the received alkali metal carbonates are very sticky and therefore accumulating onto the walls of a combustion zone. It is therefore an object of the invention to eliminate this disadvantage so that the combustion can be carried out in such a way that the alkali metal compounds are recovered as an aqueous solution of alkali metal carbonates.

This can be achieved by means of a method comprising the special features defined in the characterizing part of claim 1.

When the combustion is carried out at a temperature of at least 850° C. and the formed flue gases are rapidly and effectively mixing cooled below a sticking temperature range of the alkali metal carbonates by mixing a colder medium to the flue gases, the alkali metal carbonates have no time to stick to the walls of the combustion zone. By simultaneously pouring water on the walls of the combustion zone at least at the sticking temperature range in order to form a water film on the walls of the combustion zone, the formed alkali metal carbonates can be recovered and dissolved in water.

The method according to the present application enables thus the combustion of a dried concentrate powder or spent liquor concentrate without aluminum hydroxide addition.

An organic waste concentrate containing alkali metal compounds is combusted preferably at a temperature of about 900 to 1250° C., whereby, preferably, the amount of combustion air is controlled. An auxiliary fuel can be used, if the waste concentrate to be combusted has a low caloric value.

According to a preferable embodiment of the invention, the formed flue gases are cooled below about 600° C. by mixing to said flue gases preferably water, air and/or colder flue gas. Thereby the flue gases are very rapidly cooled below the sticking temperature range.

Instead of water, an aqueous solution from the dissolving of alkali metal carbonates can be poured on the walls of the combustion in order to concentrate it to a content suitable for further use.

The solids content of the organic waste concentrate to be combusted is preferably at least about 25% by weight, i.e. it can even be a completely dry powder, whereby it can be combusted even without any auxiliary fuel.

According to a preferred embodiment of the invention, a stoichiometric excess of limestone and/or burnt lime with respect to sulfur and silicate compounds contained in the organic waste concentrate to be combusted is added to the combustion in order to bind the sulfur and silicate compounds and to withdraw these from the process. The burnt lime and/or limestone is hereby added, preferably in a finely pulverized form, to the organic waste material prior to concentration thereof.

The method according to the invention is particularly suitable for combusting a concentrate produced by concentrating spent liquor of mechanically defibered and bleached pulp, whereby the ash formed during the combustion is mainly water-soluble alkali metal carbonate, which is dissolved in water and reused. The method is particularly useful for spent liquors which do not contain substantial amounts of silicate.

The method according to the invention is, however, also suitable for combusting very different kinds of alkali metal-containing wastes for further treatment thereof. Examples of such other wastes are sludge or wastes formed in the deinking process of recycling paper, which wastes are formed under alkaline conditions during organic syntheses carried out in a water phase, such as in hydrolyzing monochlorbenzene under alkaline conditions into benzene.

In the following, the invention will be described in more detail with reference to the appended drawing showing a sectional vertical view of a device suitable to carry out the method according to the invention.

The device comprises a combustion chamber 1 and a cooling chamber 2 extending below the combustion chamber as an extension thereof. The combustion chamber 1 is surrounded by a steel shell 3 lined at the inside with a fire-resistant masonry 4. The combustion chamber 1 is open at its bottom, and a burner 5 is provided at its top, from which burner an organic, alkali metal compounds containing waste concentrate to be combusted, and air, oxygen-riched air or oxygen needed for the combustion and optionally an auxiliary fuel are fed to the chamber 1.

The cooling chamber 2 being a lower extension of the combustion chamber 1 has its top connected to the combustion chamber 1 through flexible bellows 6 having an inlet 7 for feeding a gaseous medium, such as air or cooled flue gases, into the cooling chamber 2 in order to cool the hot flue gases coming from the combustion chamber 1 by mixing. Additionally, the inner wall 9 of the cooling chamber 2 is provided with means 8 for feeding water or a recirculated aqueous solution in order to create a water film covering said inner wall 9, in which water film the alkali metal carbonate of cooled flue gases is dissolved thus preventing it from accumulating onto said wall. Further, the bottom end of the cooling zone is provided with an outlet tube for discharging the thus formed alkali metal carbonate solution, as well as an outlet channel 11 for the cooled alkali metal free flue gases.

In the method according to the invention, a waste concentrate containing alkali metal compounds to be combusted may originate from even very different processes. It is, however, particularly suitable for the combustion of spent liquors from pulp industry, such as waste concentrates from impregnation of wood chips and bleaching of refiner mechanical pulp for recovering the alkali metal compounds contained in said wastes, as a salt solution suitable for further treatment.

When $Na_2CO_3$ is used in the impregnation and bleaching, it will be recovered by the method according to the invention as an aqueous solution 10, when the spent liquor from the impregnation and bleaching at first is concentrated and spray dried using flue gases, whereupon the thus received powder is combusted in the combustion chamber 1. Sodium is recovered as carbonate, which is reused. In the combustion chamber 1, the sulfur of the spent liquor and the sodium silicate used as an inhibitor in the bleaching, are bound to form non-soluble compounds by means of limestone added to the dry powder prior to the combustion, which compounds are removed from the circulation. If as an inhibitor, a silicate free chemical is used, no lime is consumed to remove silicate.

If sodium sulfite being the most general impregnation chemical is used in the impregnation, it is manufactured by absorbing $SO_2$ into the sodium carbonate solution.

In all alternatives, spent liquor is concentrated. The liquor is combusted in the combustion chamber 1 either as a concentrate or dried, whereby the energy for drying is received from combustion of liquor. If the liquor is combusted as a concentrate, either evaporation to a higher solids content or use of an auxiliary fuel is needed.

Dried spent liquor from a mechanical pulp process is a fine dust having a particle size of below 0.2 mm. Alternatively, the concentrate is sprayed as droplets into the combustion chamber 1 through the inlet 5 and combusted as so-called droplet combustion with excess air under oxidative conditions in the vertical combustion chamber 1 so that the gas flows from the top downwardly. In this respect, the combustion differs essentially from combustion in a soda recovery boiler wherein the combustion takes places under reductive conditions.

The dried dust is preferably manufactured from spent liquor concentrate in a spray-drier. In the method according to the invention, no addition of aluminum hydroxide is needed.

It depends on the production process of mechanical pulp, whether the spent liquor concentrate contains sulfur and/or silicate.

Experimentally and from the literature of the art it is known that the combustion time of the organic part of dried spent liquor in a dried form is below 5 sec. The measured caloric value is above 10 MJ/kg.

The temperature of the combustion chamber 1 is adjusted by means of excess air to at least about 850° C., and preferably to a range of 900 to 1250° C. At this temperature, sodium contained in the powder of spent liquor will evaporate and react mainly with the carbon dioxide of the combustion gases to sodium carbonate. After the combustion chamber 1, air or exhaust gases from a drying process are mixed to the hot flue gas flow in the cooling chamber 2. Prior to mixing, the gas flow is throttled in order to obtain a good mixture.

On the inner walls 9 of the cooling chamber 2, a water film is created to ensure that formed sodium carbonate will not stick to said inner wall 9.

In the cooling chamber 2, the temperature of the flue gas is adjusted below about 600° C. by a mixing cooling process. With respect to the operation and process chemistry, the cooling chamber 2 is nearly identical with the tail end of a soda recovery boiler. Therefrom it is known that fly ash does not stick to the inner walls of the soda recovery boiler, even under disadvantageous conditions, at a temperature below 600° C.

Also possible unreacted gaseous sodium will react in the cooling chamber 2 to sodium carbonate. A part of this carbonate will dissolve in the water film and in an aqueous solution at the bottom of the cooling chamber 2 forming an aqueous solution of sodium carbonate. The carbonate fly ash remained in the gas flow 1 is separated from the gas flow, for example, by means of an electrostatic filter, in the same way as in a soda recovery boiler.

Prior to the electrostatic filter, heat can be recovered from the combustion gases in a steam generator.

After the electrostatic filter, the gases are at a temperature of about 400 to 300° C. which is suitable for feeding into a spray drier.

Carbonate ash separated by means of the electrostatic filter is dissolved in the salt solution 10 discharged from the cooling chamber 2, and the sodium content of the solution is adjusted according to the requirements of the defibering process. If sodium sulfite is desired to be used in the defibering process, it is manufactured by absorbing $SO_2$ gas into the sodium carbonate solution by using known technology.

Also elements being contained in the wood and ions added and formed during the process will end up in the carbonate ash. These are present in the ash as oxides and they are filtered from the carbonate solution by known filtering/separating procedures, for example by means of a drum filter or a decanter centrifuge.

If spent liquor contains sulfur and/or silicate, a suitable amount of calcium carbonate or burnt lime is added to the spent liquor prior to spray-drying. What will be a suitable amount varies from case to case, but the molar ratio of calcium and sulfur as well as silicate should be higher than 1. In the combustion, sulfur reacts under oxidative conditions to sulfur dioxide and sulfur trioxide. These, in turn, react, as known, to calcium sulfite and calcium sulfate. Both compounds have a low solubility in water and will end up in the precipitate when filtered. Silicate reacts during combustion to calcium silicates, also having a low solubility in water, and they are withdrawn from the process by filtering the carbonate solution.

When oxidized green liquor ($Na_2CO_3$, $Na_2SO_4$) or oxidized white liquor (NaOH, $Na_2SO_4$) is used in the impregnation and bleaching, the ratio of sulfur to sodium of a sulfate plant can be adjusted by withdrawing the excess of sulfur as calcium sulfate.

By such a procedure it is possible to recover both the sodium of sodium sulfite possibly used in the impregnation and the sodium of sodium silicate used in the bleaching as sodium carbonate. Simultaneously, both sulfur and silicon form poorly soluble compounds, which are withdrawn from the process as depositable waste.

If conventional chemicals, such as sodium sulfite and sodium silicate, are intended to be used in the defibering process, sulfur and silicate are withdrawn from the chemical circulation in the above described manner. Sodium sulfite is manufactured by absorbing $SO_2$ gas into a sodium carbonate solution by using known technology. Sodium silicate and $SO_2$ are bought from an outside deliverer.

It is obvious to a person skilled in the art that the method according to the invention can be altered very broadly within the scope of claim 1 without departing from the scope of the invention. Thus, it is, for example, obvious to a person skilled in the art that origin and composition of the organic waste concentrate containing alkali metal compounds and intended to be combusted in the method according to the invention can vary widely. It is also clear that additional fuel can be used in the combustion, if required, and that various additives can be added to the waste concentrate prior to the combustion.

What is claimed is:

1. A method for combusting an organic waste concentrate containing alkali metal compounds, said combustion being carried out at a temperature of at least 850° C., and flue gases formed during the combustion are cooled by mixing a colder medium to the flue gases, wherein the combustion is carried out under oxidative conditions in the presence of excess air for recovering said alkali metal compounds as alkali metal carbonates, to be dissolved in water to form a recoverable aqueous solution, said flue gases being cooled below a sticking temperature range of the alkali metal carbonates simultaneously as water or a recirculated aqueous solution is poured on the walls of a cooling zone at least at the sticking temperature range to create a water film covering said walls.

2. The method according to claim 1, wherein the combustion is carried out at a temperature ranging from 900 to 1250° C., which is controlled by the amount of combustion air.

3. The method according to claim 2, wherein the formed flue gases are cooled below 600° C. by mixing water and/or air and/or colder flue gas to said formed flue gases.

4. The method according to claim 2, wherein an aqueous solution containing dissolved alkali metal carbonates is poured on the walls of the cooling zone.

5. The method according to claim 2, wherein a waste concentrate having a solids content of at least about 25% by weight is combusted.

6. The method according to claim 2, wherein a stoichiometric excess of limestone and/or burnt lime with respect to sulfur and silicate compounds contained in the waste concentrate to be combusted is added to the combustion.

7. The method according to claim 2, wherein limestone and/or burnt lime is added in a finely pulverized form to a waste concentrate to be combusted prior to drying thereof.

8. The method according to claim 2, wherein the waste concentrate to be combusted is a dry powder.

9. The method according to claim 2, wherein the waste concentrate to be combusted is a spent liquor concentrate from impregnation and/or bleaching of mechanical or chemi-mechanical pulp.

10. The method according to claim 1, wherein the formed flue gases are cooled below 600° C. by mixing water and/or air and/or colder flue gas to said formed flue gases.

11. The method according to claim 10, wherein an aqueous solution containing dissolved alkali metal carbonates is poured on the walls of the cooling zone.

12. The method according to claim 10, wherein a waste concentrate having a solids content of at least about 25% by weight is combusted.

13. The method according to claim 10, wherein a stoichiometric excess of limestone and/or burnt lime with respect to sulfur and silicate compounds contained in the waste concentrate to be combusted is added to the combustion.

14. The method according to claim 10, wherein limestone and/or burnt lime is added in a finely pulverized form to a waste concentrate to be combusted prior to drying thereof.

15. The method according to claim 1, wherein an aqueous solution containing dissolved alkali metal carbonates is poured on the walls of the cooling zone.

16. The method according to claim 1, wherein a waste concentrate having a solids content of at least about 25% by weight is combusted.

17. The method according to claim 1, wherein a stoichiometric excess of limestone and/or burnt lime with respect to sulfur and silicate compounds contained in the waste concentrate to be combusted is added to the combustion.

18. The method according to claim 17, wherein limestone and/or burnt lime is added in a finely pulverized form to a waste concentrate to be combusted prior to drying thereof.

19. The method according to claim 1, wherein the waste concentrate to be combusted is a dry powder.

20. The method according to claim 1, wherein the waste concentrate to be combusted is a spent liquor concentrate from impregnation and/or bleaching of mechanical or chemi-mechanical pulp.

* * * * *